US008502812B2

(12) United States Patent
Lee et al.

(10) Patent No.: US 8,502,812 B2
(45) Date of Patent: Aug. 6, 2013

(54) LIQUID CRYSTAL DISPLAY DEVICE AND DRIVING METHOD THEREOF, AND MOBILE TERMINAL HAVING THE SAME, FOR PREVENTING WHITE OR BLACK EFFECT

(75) Inventors: Sung Hyup Lee, Gumi-si (KR); Jae Ser Lee, Gumi-si (KR); Hye Jin Lee, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1062 days.

(21) Appl. No.: 11/798,697

(22) Filed: May 16, 2007

(65) Prior Publication Data

US 2008/0043011 A1 Feb. 21, 2008

(30) Foreign Application Priority Data

Jul. 10, 2006 (KR) ..... 10-2006-0064432
Jan. 18, 2007 (KR) ..... 10-2007-0005661

(51) Int. Cl.
*G09G 5/00* (2006.01)

(52) U.S. Cl.
USPC ..... 345/212

(58) Field of Classification Search
USPC ..... 345/212, 211
See application file for complete search history.

(56) References Cited

U.S. PATENT DOCUMENTS 5,625,373 A * 4/1997 Johnson ..... 345/100
5,644,331 A * 7/1997 Hazama ..... 345/904
5,877,733 A * 3/1999 Uchida et al. ..... 345/50
6,337,687 B1 * 1/2002 Lee ..... 345/212
6,373,479 B1 * 4/2002 Moon ..... 345/211
6,556,192 B2 * 4/2003 Jang ..... 345/204
6,615,360 B1 9/2003 Amini et al.
6,744,429 B2 * 6/2004 Ra ..... 345/211
6,930,664 B2 * 8/2005 Kim et al. ..... 345/214
7,256,778 B1 * 8/2007 Choi ..... 345/213
7,646,371 B2 * 1/2010 Maki ..... 345/211
2003/0184538 A1 * 10/2003 Yamato et al. ..... 345/211
2006/0001661 A1 * 1/2006 Mori ..... 345/211
2006/0158421 A1 * 7/2006 Masuko ..... 345/100
2006/0170641 A1 * 8/2006 Song et al. ..... 345/98
2006/0176263 A1 * 8/2006 Kang et al. ..... 345/98
2007/0035533 A1 * 2/2007 Kim ..... 345/204

FOREIGN PATENT DOCUMENTS

JP 03-296090 12/1991
JP 11-296134 A 10/1999
KR 100490391 1/2000
KR 10-2004-0073885 8/2004
KR 10-2005-0122655 12/2005
KR 10-2007-0027384 3/2007

* cited by examiner

*Primary Examiner* — Adam J Snyder

(74) *Attorney, Agent, or Firm* — Roylance, Abrams, Berdo and Goodman, LLP

(57) ABSTRACT

A liquid crystal display (LCD) device of a mobile terminal and a driving method of the LCD device are provided, including an LCD panel for presenting images, driver ICs for driving the LCD panel, and a system controller for comparing a measured signal with a normal state signal and initializing the driver ICs according to a difference between the measured signal and the normal state signal.

15 Claims, 7 Drawing Sheets

LIQUID CRYSTAL DISPLAY DEVICE AND DRIVING METHOD THEREOF, AND MOBILE TERMINAL HAVING THE SAME, FOR PREVENTING WHITE OR BLACK EFFECT

CROSS-REFERENCE TO RELATED PATENT APPLICATION

This application claims the benefit under 35 U.S.C. §119 (a) of Korean Patent Applications filed in the Korean Intellectual Property Office on Jul. 10, 2006, and assigned Serial No. 2006-64432, and on Jan. 18, 2007, and assigned Serial no. 2007-05661, the entire disclosure of which are hereby incorporated by reference.

BACKGROUND OF THE INVENTION

1. Field of the Invention

The present invention relates to a mobile terminal. More particularly, the present invention relates to a liquid crystal display (LCD) device of a mobile terminal and a driving method of the LCD device.

2. Description of the Related Art

A liquid crystal display (LCD) is a thin, flat display device comprising a plurality of color or monochrome pixels arrayed in front of a light source or reflector. An LCD device includes a LCD panel, driving circuit generating signals for driving the LCD panel, and a backlight assembly illuminating the LCD panel. Typically, such an LCD device is provided with a grounding structure for protecting the circuits from static electricity.

Slim, compact, and lightweight designs have become a mainstream for the market of mobile terminals.

However, the slim design of a mobile terminal presents difficulties in implementing the grounding structure for the LCD device.

In order to accommodate the slim designs of the mobile terminals, the grounding structure is also required to occupy a small space. This results in degradation of the electrostatic protection effect.

Also, the conventional grounding structure is implemented with an insulation tape. The adhesion of the insulation tape is time consuming and burdensome.

The degradation of the electrostatic protection causes variations of the level of the driving signal provided to the LCD panel and results in the transition of all the signal values to a uniform level which ultimately results in a white or black effect.

Accordingly, there is a need for an improved liquid crystal display device in a mobile terminal and driving method thereof that prevents the occurrences of a white or black effect.

SUMMARY OF THE INVENTION

An aspect of exemplary embodiments of the present invention is to address at least the above problems and/or disadvantages and to provide at least the advantages described below. Accordingly, an aspect of exemplary embodiments of the present invention is to provide an LCD device of a mobile terminal and driving method thereof that are capable of protecting an LCD panel from suffering a white or black effect by initializing input voltage of the LCD device when the white or black effect is predicted.

It is another aspect of exemplary embodiments of the present invention to provide an LCD device of a mobile terminal and driving method thereof which are capable of enhancing display quality of an LCD panel of the LCD device by protecting the LCD panel from experiencing a white or black effect.

It is still another aspect of exemplary embodiments of the present invention to provide an LCD device of a mobile terminal and driving method thereof which are capable of improving productivity by removing insulation tape application process, which requires expensive insulation tape and, equipments, time, and labor to adhere the insulation tape.

In accordance with an aspect of an exemplary embodiment of the present invention, the above and other objects can be accomplished by a liquid crystal display (LCD) device. The LCD device comprises an LCD panel, driver ICs and a system controller. The LCD panel presents images, the driver ICs drive the LCD panel and the system controller compares a signal generated by the driver ICs and initializes the driver ICs according to a difference between the measured signal and the normal state signal.

In accordance with another aspect of an exemplary embodiment of the present invention, the above and other objects can be accomplished by a mobile device. The mobile device includes a liquid crystal display (LCD) device, a system controller and a system power source. The LCD device displays images. The system controller compares a measured signal level with a normal state signal level and initializes the LCD device according to a difference between the measured signal level and the normal state signal level. The system power source supplies power to the LCD device under the control of the system controller.

In accordance with another aspect of exemplary embodiments of the present invention, the above and other objects can be accomplished by a method for driving a liquid crystal display (LCD) device. The method for driving the LCD device includes measuring a voltage level of a signal provided to an LCD panel of the LCD device; comparing the measured voltage level with a voltage level of a normal state of the LCD panel; and initializing the signal provided to the LCD panel if the measured voltage level differs from the reference voltage level.

BRIEF DESCRIPTION OF THE DRAWINGS

The above and other objects, features and advantages of certain exemplary embodiments of the present invention will be more apparent from the following detailed description taken in conjunction with the accompanying drawings, in which.

Throughout the drawings, the same drawing reference numerals will be understood to refer to the same elements, features and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

In the exemplary embodiments of present invention, the mobile terminal is provided with an abnormal signal detection line for detecting an abnormal signal level causing a white or black effect, such that, if a signal level similar to the abnormal signal level is detected, the mobile terminal initializes voltage level input to the LCD panel to prevent occurrence of the white or black effect.

The following description of the exemplary embodiments of the present invention is given for a mobile terminal as an example, but can be applied to other devices such as personal digital assistants (PDAs), smart phones, MP3 Players, laptop computers, personal computers, digital cameras, cellular phones, personal communication service (PCS) phones, dedicated DMB receivers, International Mobile Telecommunication 2000 (IMT-2000) terminals, Universal Mobile Telecommunication Service (UMTS) terminals, and the like.

As an LCD panel driving unit of an exemplary embodiment of the present invention, an LCD Driver Integrated Circuit (LDI) is utilized for providing driving signals and data.

LDIs are classified according to the type of LCD panel, such as Twisted Nematic (TN), Super Twisted Nematic (STN), and Thin Film Transistor (TFT).

The TFT LDI includes a gate driver integrated circuit (IC) and data driver IC. A number of the LDIs are determined by a size of the LCD panel and a number of possible colors of the LCD panel. Typically, an LCD panel is implemented with one to dozens of LDIs. The present invention is described with the TFT LDI as an example.

Figure 1:
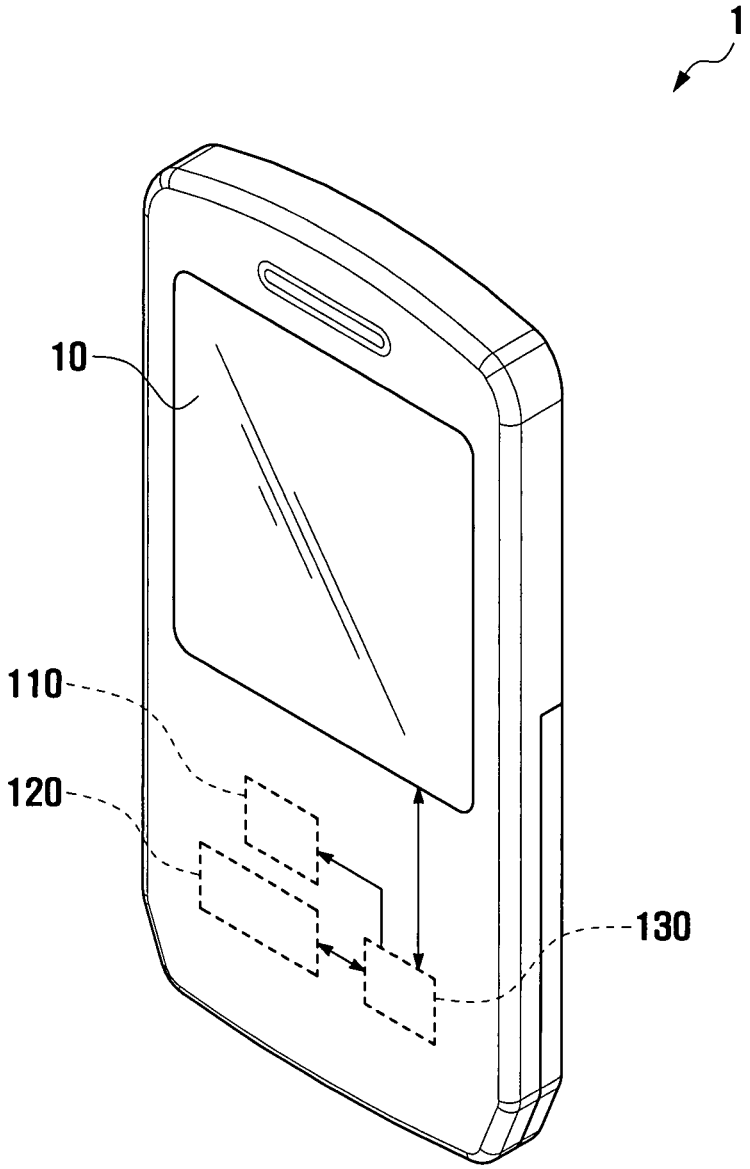
FIG. 1 is a perspective view illustrating a mobile terminal according to an exemplary embodiment of the present invention.
Figure 3:
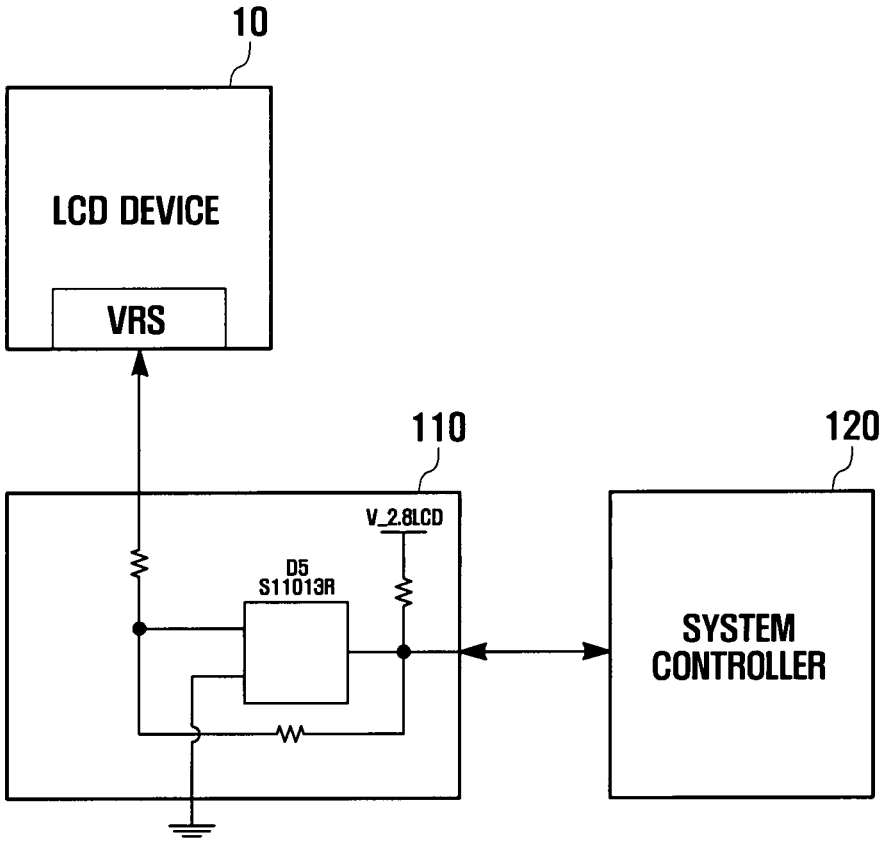
FIG. 3 is a block diagram illustrating an abnormal signal detection circuit of the mobile terminal of FIG. 1.

FIG. 1 is a perspective view illustrating a mobile terminal according to an LCD device of the mobile terminal of FIG. 1 and FIG. 3 is a block diagram illustrating an abnormal signal detection circuit of the mobile terminal of FIG. 1.

According to an exemplary embodiment of the present invention, the mobile terminal of FIG. 1 includes an LCD device 10 for displaying images, an abnormal signal detection circuit 110 for detecting signals causing a white or black effect, a system controller 120 for controlling signals provided including video signals to the LCD device 10, and a power source 130 supplying a voltage for operating the mobile terminal 1.

The LCD device 10 converts analog video signals and control signals received from the system controller 120 into digital signals required to drive the display panel of the LCD device 10.

Figure 2:
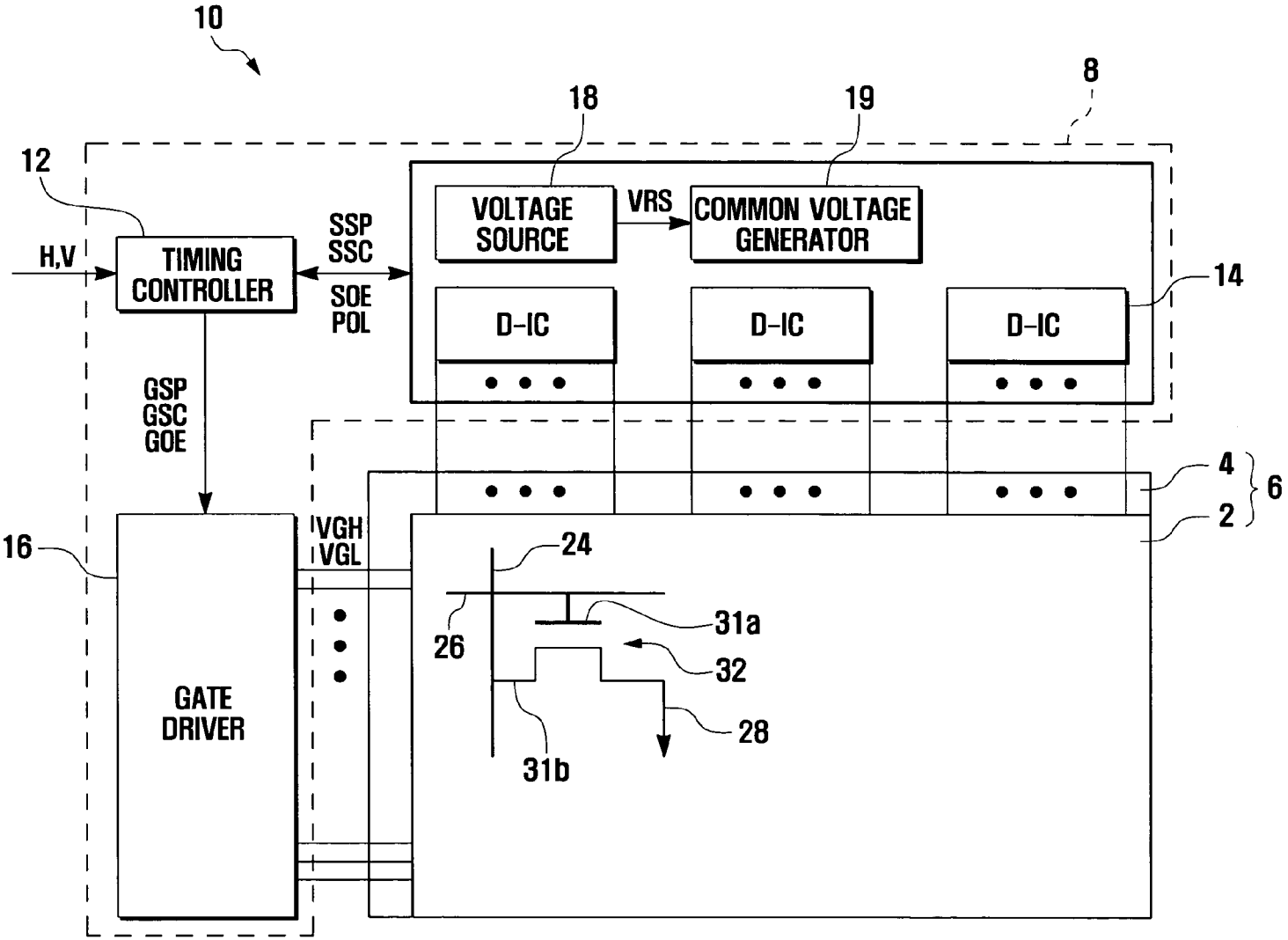
FIG. 2 is a block diagram illustrating an LCD device of the mobile terminal of FIG. 1.

Referring to FIG. 2, the LCD device 10 includes an LCD panel 6 and an LDI 8 for driving the LCD panel 6.

The LCD panel 6 is formed by abutting an upper substrate 2 and a lower substrate 4, liquid crystal filled out between the substrates 2 and 4, and a plurality of spacers arranged for uniformly maintaining a gap between the substrates.

The upper substrate 2 of the LCD panel 6 is provided with a common electrode, a planarization layer, a color filter, and a black matrix.

The lower substrate 4 of the LCD panel 6 includes gate lines 26 and data lines 24 crossing the gate lines 26 to define a liquid crystal cell 28, which is independently driven by a thin film transistor (TFT) 32.

A gate terminal 31*a* of the TFT 32 is coupled with a gate line 26 and a source terminal 31*b* of the TFT 32 is coupled with a data line 24. The TFT 32 facilitates the provision of a pixel signal to the liquid crystal cell 28 through the data line 24 in response to a scan signal from the gate line 26.

The liquid crystal cell 28 expresses a gradient by adjusting light transmission by varying alignments of liquid crystal molecules which have a dielectric anisotropic property according to an electric field formed by a difference between the common voltage provided to the common electrode and the pixel voltage provided to the pixel electrode.

The LDI 8 includes a timing controller 12, a data driver 14, a gate driver 16, a voltage source 18, and a common voltage generator 19.

The timing controller 12 generates gate control signals (gate start pulse (GSP), gate shift clock (GSC), gate output enable (GOE) signals) for controlling operation of the gate driver 16 and data control signals (source start pulse (SSP), source shift clock (SSC), source output enable (SOE), polarity control (POL) signals) for controlling operation of the gate driver, using synchronization signals (H, V) provided from the system controller 120.

The timing controller 12 also converts the data signals received from the system controller 120 to properly drive the LCD panel 6 and then transmits the converted signal to the data driver 14.

The data driver 14 provides the pixel signals for every horizontal period by the data line 24. The data driver 14 provides the pixel signals to the data lines 24 in response to the data control signals (SSP, SSC, SOE, POL) provided from the timing controller 12.

The data driver 14 also converts the pixel data from the timing controller 12 to analog pixel signals using a gamma voltage provided from a gamma voltage generator (not shown).

The data driver 14 generates a sampling signal by shifting a source start pulse (SSP) according to a source shift clock (SSC). The data driver 14 then sequentially latches the pixel data in a predetermined unit in response to the sampling signal. According to an exemplary implementation, the data driver 14 converts the latched pixel data per line into an analog pixel signal and provides the analog pixel signal to the data lines 24 during a SOE duration. The data driver 14 converts the pixel data into a positive or negative pixel signal in response to a POL.

The gate driver 16 drives the gate lines 26 in a sequential order under the control of the timing controller 12. That is, the gate driver 16 provides gate high voltage to the gate lines 26 in a sequential order in response to the gate control signals (GSP, GSC, GOE).

The gate driver 16 generates shift pulse by shifting the gate start pulse (GSP) according to a gate shift clock (GSC). The gate driver 16 then provides the gate high voltage to the gate lines 26 every horizontal period in response to the shift pulse.

The shift pulse is shifted one line after another every horizontal period and the gate driver 16 provides the gate high voltage to the gate line 26 corresponding to the shift pulse. The gate driver 16 provides the gate low voltage to the gate lines 26 when the gate high voltage is not provided.

The voltage source 18 generates voltages required for operating the LCD device using the input voltage from the system power source 130 and provides the voltages to the timing controller 12, common voltage generator 19, data driver 14, and gate driver 16.

The common voltage generator 19 generates a common voltage using a reference signal (VRS) from the voltage source 18. The common voltage is a reference voltage for driving the liquid crystal cell 28.

The abnormal signal detection circuit 110 is structured to detect a value of the signal provided from a specific line of the LDI 8 of the LCD device 10.

Referring to FIG. 3, the abnormal signal detection circuit 110 is implemented to detect a signal on the reference signal line providing the signal having the lowest voltage level among the voltage-related signals of the LDI 8, and to provide the detected signal to the system controller 120.

The abnormal signal detection circuit 110 can use the gate high voltage or gate low voltage, which is generated by the gate driver 16 and provided to the LCD panel 6. Normally, the gate high voltage (VGH) has a voltage level of 13~15V and the gate low voltage (VGL) is about −10V such that the difference is less than 25V. The black effect typically occurs when the gate high voltage (VGH) is about 2.8V and the gate low voltage (VGL) is about 0V.

Accordingly, the abnormal signal detection circuit 110 can be installed for sensing the gate low voltage (VGL) and gate high voltage (VGH) on the gate line 26 or can be implemented with an additional abnormal signal detection line, resulting in prediction of black or white effect occurrence.

The system controller 120 controls the overall operation of the mobile terminal and especially provides signals for displaying images on the LCD device 10. The system controller 120 initializes the LCD device by controlling a power-on sequence of the voltage source 18 of the LCD device 10 by adjusting the system power source 130.

In more detail, the system controller 120 monitors the reference signal (VRS) provided to the LCD panel 6 from the voltage source 18 of the LCD device 10. According to an exemplary implementation, the abnormal signal detection circuit 110 or the system controller 120, for example, monitors a value of the reference signal (VRS) through the General Purpose Input/Output (GPIO) port.

If the reference signal (VRS) fluctuates, the system controller 120 predicts occurrence of the black or white effect and controls the system power source 130. That is, the system controller 120 initializes the power sequence of the voltage source 18 of the LCD device 10 by controlling the system power source 130.

In an exemplary embodiment of the present invention, the interoperation among the LCD device 10, the abnormal signal detection circuit 110, and the system controller 120 is described. However, exemplary embodiments of the present invention are not limited thereto, and can be implemented with an individual element constituting the mobile terminal.

For example, by directly connecting the reference signal (VRS) having the lowest voltage level among power down LDI levels to the GPIO port, the system controller 120 can perform the function of the abnormal signal detection circuit 110. According to an exemplary implementation, the abnormal signal detection circuit 110 is not required.

In FIG. 3, the abnormal signal detection circuit 110 is implemented to cooperate with the LCD device 10, the system controller 120, a detection line and the system power source 130. The system controller 120 compares the signals generated by the LCD device 10 with the reference signals and initializes the LCD device 10 when the difference between the compared signals is greater than a tolerable value. The detection line connects the LCD device 10 and the system controller 120 and transfers the detected signal to the system controller 120. The system power source 130 supplies power to the LCD device 10. Through the abnormal signal detection circuit 110, the voltage from the reference signal (VRS) is stepped down to a selected level for proper operation of the system controller 120, so that the abnormal signal detection circuit 110 acts as a system controller protection circuit.

Figure 4:
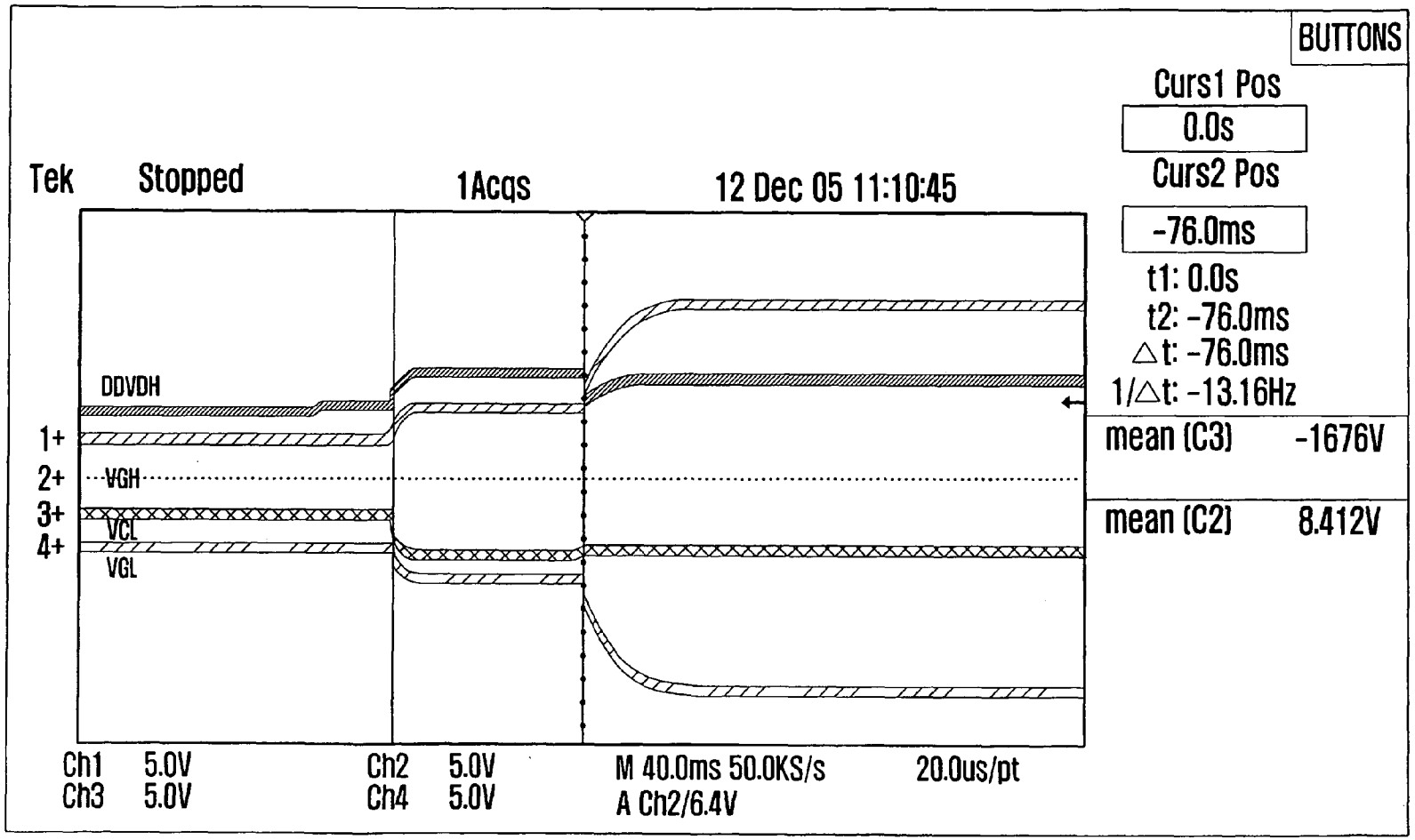
FIG. 4 is a graph illustrating a power sequence when an LCD device is in a normal mode.

The initialization of the LCD device 10 is performed in a clam shell type mobile terminal, when the clam shell is closed and then opened and in a slide type mobile terminal, when a sliding member is slid up. The power sequence is depicted in FIG. 4 when the LCD device 10 is in a normal mode.

The system controller 120 is provided with a code initializing the LCD power-on sequence for controlling the voltage source 18 of the LCD device 10 to control the voltage source 18 and the system power source 130.

The system power source 130 supplies power required for operating the mobile terminal 1. The system power source 130 initializes the power to the LCD device under the control of the system controller 120, when an occurrence of black or white effect is predicted.

Figure 5:
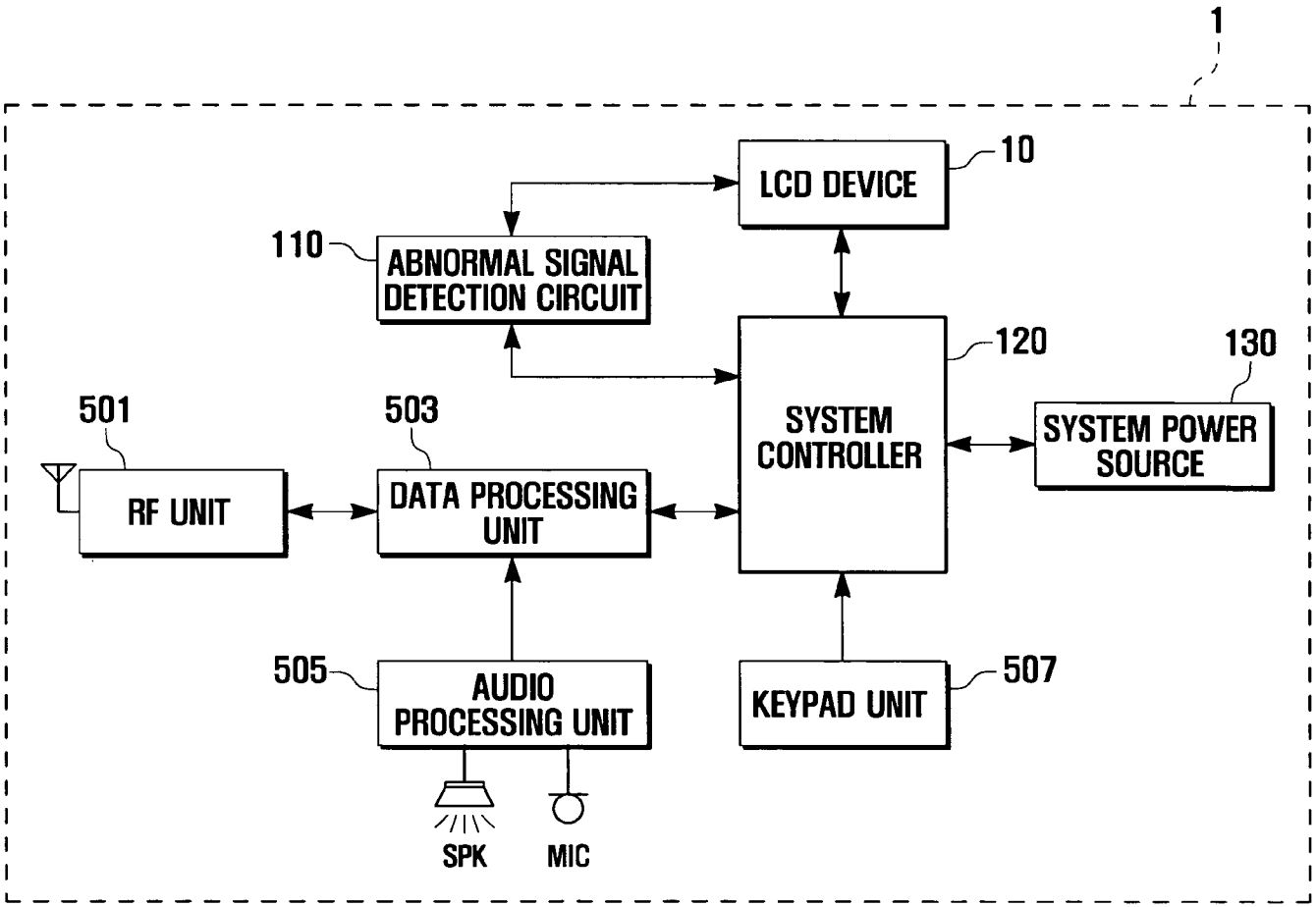
FIG. 5 is a block diagram illustrating a configuration of the mobile terminal of FIG. 1 according to an exemplary embodiment of the present invention.

FIG. 5 is a block diagram illustrating a configuration of the mobile terminal of FIG. 1 according to an exemplary embodiment of the present invention.

Referring to FIG. 5, the mobile terminal 1 includes the LCD device 10, the abnormal signal detection circuit 110 for detecting a signal causing the black or white effect, a system controller 120 providing data signals to the LCD device 10, the system power source 130 for supplying power required to operate the mobile terminal 1, a radio frequency (RF) unit 501, a data processing unit 503, an audio processing unit 505, and a keypad unit 507.

Since the LCD device 10, the abnormal signal detection circuit 110, the system controller 120, and the system power source 130 have structures and functions identical to the mobile terminal of FIG. 1, detailed descriptions of these elements are omitted for clarity and conciseness.

The RF unit 501 comprises a radio frequency transmitter and a radio frequency receiver, which are both coupled to an antenna which is used for transmitting and receiving radio signals through an air channel. The RF unit 501 is coupled to the data processing unit 503, which processes digital signals into a form that can be transmitted by the transmitter of RF unit 501 or processes baseband signals received and modulated by the receiver of the RF unit 501 into digital form for other units of the portable phone.

The data processing unit 503 includes a means for encoding and modulating a signal to be transmitted through the RF unit 501 and a means for demodulating and decoding a signal received through the RF unit 501. The signals received through the data processing unit 503 are transferred to the LCD device 10 to be displayed as an image under the control of the system controller 120.

The audio processing unit 505 converts analog audio signals received at a microphone (MIC) into digital signals and converts digital audio signals received from the data processing unit 503 into analog audio signals to be played over a speaker (SPK).

The keypad unit 507 includes a plurality of alphanumeric keys for facilitating a user's ability to input alphanumeric characters and various function keys enabling the user to input commands for operating corresponding functions. The keypad unit 507 also includes a turn-on and turn-off key for turning on and turning off the mobile terminal 1.

The mobile terminal 1 can be implemented without the abnormal signal detection circuit.

Figure 6:
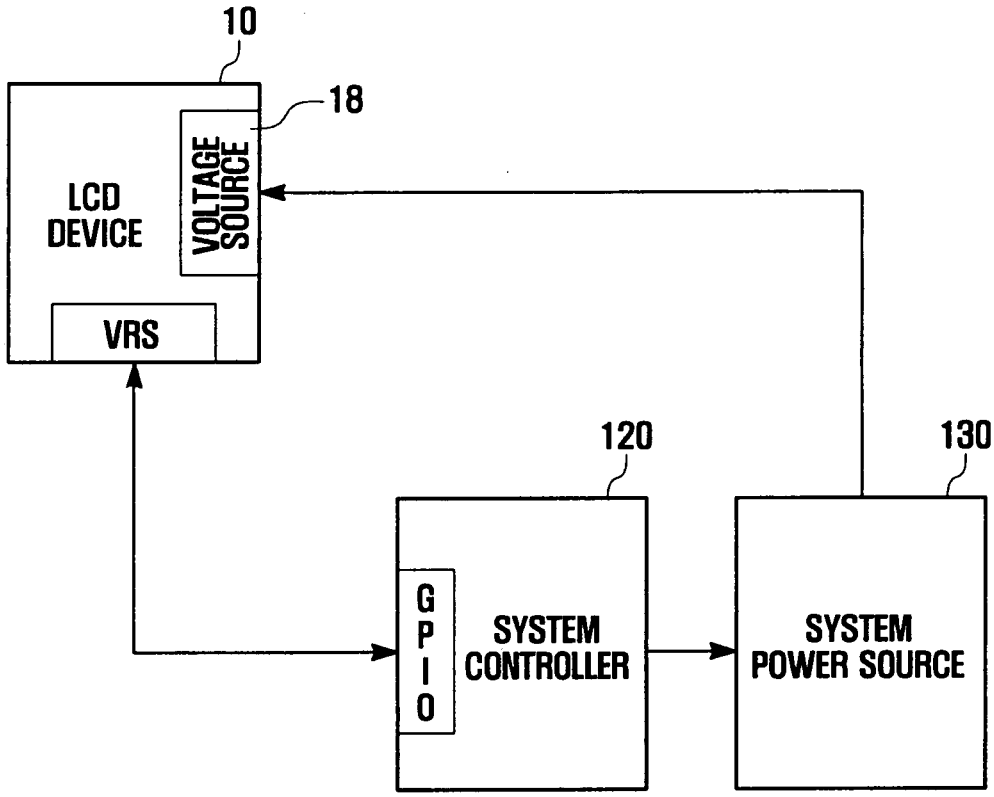
FIG. 6 is a schematic block diagram illustrating a white/black effect control part of an LCD device according to an exemplary embodiment of the present invention.

FIG. 6 is a schematic block diagram illustrating a white/black effect control part of an LCD device according to an exemplary embodiment of the present invention.

Referring to FIG. 6, the mobile terminal according to an exemplary embodiment of the present invention includes an LCD device 10, a power source 130 and a system controller 120. The power source 130 supplies power to the LCD device 10 and the power source 130 controls the voltage source 18. The system controller 120 controls the general operation of the LCD device 10, determines an occurrence of a black or white effect when a variation of the reference signal (VRS) is detected from the LCD device 10, and adjusts the black or white effect by controlling the power source 130 to initialize the LCD device 10, such as initializing the voltage source 18 of the LCD device 10.

The system controller 120 is provided with a GPIO port for detecting the reference signal (VRS). The GPIO port is connected to the voltage source 18 for supplying the reference signal (VRS). The system controller 120 compares a value of the reference signal (VRS) detected through the GPIO port with a value of the normal state reference signal (VRS) to verify a difference between the two values, and controls to initialize the LCD device according to the difference. The system controller 120 inspects the gate driver and gate lines of LDI of the LCD device 10 to verify the variation of the gate high voltage and gate low voltage supplied to the gate driver and the gate lines. According to an exemplary implementation, the system controller 120 can detect abnormal gate voltage and control the power source 130 for handling the black or white effect of the LCD device 10.

In the mobile terminal according to an exemplary embodiment of the present invention, a detection circuit is removed, and a GPIO port is directly connected to the LCD device 10 for sensing the signal variation. The system controller 120 may perform a voltage or current drop when the signal input to the GPIO port has a high voltage or current value for stabilizing the GPIO port.

Figure 7:
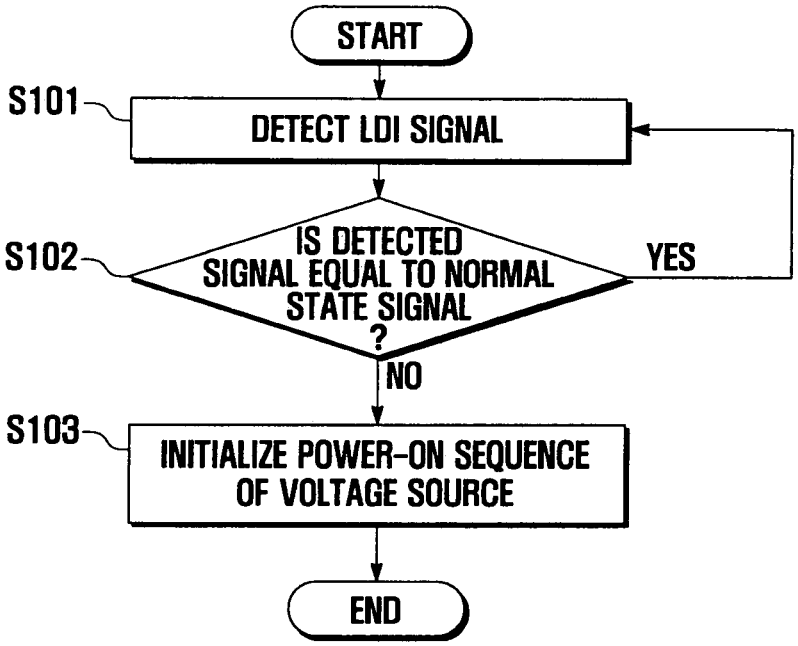
FIG. 7 is a flowchart illustrating an LCD device driving method according to an exemplary embodiment of the present invention.

FIG. 7 is a flowchart illustrating an LCD device driving method according to an exemplary embodiment of the present invention.

Referring to FIG. 7, the mobile terminal 10 initially detects a signal from the LDI 8 (S101).

The abnormal signal detection circuit 110 detects the signals generated by the voltage source 18 and the gate driver 16. The abnormal signal detection circuit 110 detects the reference signal (VRS) provided from the voltage source 18 to the common voltage generator 19 or detects the gate high voltage (VGH) and the gate low voltage (VGL) provided from the gate driver 16 to the LCD panel 6. Separately added detection lines can be formed at the voltage source 18 generating the reference signal (VRS) or the gate driver 16 generating the gate high voltage (VGH) and the gate low voltage (VGL) in order to detect the signals.

Next, the detected signal is transfers to the system controller 120, and the system controller 120 compares the detected signal with a normal state signal and determines whether the detected signal corresponds to the normal state signal (S102).

If the detected signal is, for example, substantially equal to the normal state signal, the mobile terminal repeats the step S101.

If the detected signal is not equal to the normal state signal, the mobile terminal initializes the power-on sequence of the voltage source 18 (S103).

At step S103, the system controller 120 transmits a control signal for initializing the power-on sequence of the voltage source 18 of the LCD device 10 to the voltage source 18 such that the voltage source 18 resets the power-on sequence according to the control signal, resulting in a non-occurrence of the black or white effect.

In an exemplary embodiment of the present invention, the black or white effect of the LCD device is detected using an abnormal signal detection circuit 110. However the exemplary embodiment of the present invention is not limited thereto but can be implemented such that the system controller 120 directly detects the signal generated at LDI of the LCD device 10.

As described above, an LCD device of a mobile terminal and the driving method of the LCD device according to the exemplary embodiments of the present invention can predict an occurrence of a black or white effect and avoid the occurrence of the black or white effect by initializing the input voltage of the LCD device.

Also, the LCD device of a mobile terminal and the driving method of the LCD device according to an exemplary embodiment of the present invention are capable of enhancing display quality of an LCD panel of the LCD device by protecting the LCD panel from experiencing a white or black effect.

Also, the LCD device of a mobile terminal and the driving method of the LCD device according to exemplary embodiments of the present invention improve productivity by removing an insulation tape application process, which requires expensive insulation tape and equipment, time, and labor to adhere the insulation tape.

While the present invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A liquid crystal display device comprising:

a system controller;

a liquid crystal display panel for presenting images;

a driver IC for driving the liquid crystal display panel, the driver IC comprising a timing controller that generates gate control signals for controlling operation of a gate driver, and data control signals for controlling operation of a data driver using synchronization signals provided from the system controller; and an abnormal signal detector for selecting a signal having the lowest voltage level among voltage-related signals generated by the driver IC;

where the system controller compares the signal having the lowest voltage level generated at the driver IC with a normal state signal and activates the driver IC to initialize a power-on sequence of the voltage source when a difference between voltage levels of the signal having the lowest voltage level generated by the driver IC and the normal state signal is greater than a predetermined value.

2. The liquid crystal display device of claim 1, wherein the driver IC comprises:

a data driver for providing data signals to data lines of the liquid crystal display panel;

a gate driver for providing high gate voltage and low gate voltage to gate lines of the liquid crystal display panel;

a common voltage generator for providing a common voltage through a common electrode of the liquid crystal display panel; and the voltage source for supplying a reference signal to the liquid crystal display panel and the driver.

3. The liquid crystal display device of claim 1, wherein the system controller predicts an occurrence of at least one of a black and white effect when the signal generated by the driver IC differ from the normal state signal.

4. The liquid crystal display device of claim 1, wherein the system controller comprises a general purpose input/output (GPIO) port for receiving a signal generated by the driver outputting a driver activation signal.

5. The liquid crystal display device of claim 1 further comprises a detector for detecting the signal generated by the driver IC and for transmitting the detected signal to the system controller.

6. The liquid crystal display device of claim 1, wherein the detector modifies a level of the signal generated by the driver IC to a selected level to be processed by the system controller.

7. A mobile device comprising:

a system controller;

a liquid crystal display device for displaying images;

a driver IC for driving the liquid crystal display panel, the driver IC comprising a timing controller that generates gate control signals for controlling operation of a gate driver, and data control signals for controlling operation of a data driver using synchronization signals provided from the system controller;

an abnormal signal detector for selecting a signal having the lowest voltage level among voltage-related signals generated by the driver IC;

the system controller for comparing the selected signal having the lowest voltage level with a normal state signal level and initializing a power-on sequence of the voltage source of the liquid crystal display device when a voltage level difference between the selected signal and the normal state signal level is greater than a predetermined value; and a system power source for supplying power to the liquid crystal display device.

8. The mobile device of claim 7, wherein the liquid crystal display device comprises:

a liquid crystal display panel for presenting images;

the data driver for providing data signals to data lines of the liquid crystal display panel;

the gate driver for providing high gate voltage and low gate voltage to gate lines of the liquid crystal display panel;

a common voltage generator for providing a common voltage through a common electrode of the liquid crystal display panel; and the voltage source for supplying a reference signal to at least one of the liquid crystal display panel, the data driver, gate driver, and common voltage generator.

9. The mobile device of claim 7, wherein the abnormal signal detector measures at least one of a gate high voltage, a gate low voltage, and a reference signal.

10. The mobile device of claim 7, wherein the abnormal signal detector transmits the selected signal to the system controller.

11. The mobile device of claim 7, wherein the abnormal signal detector modifies a level of the signal generated by the liquid crystal display device to a selected level which can be processed by the system controller.

12. A method for driving a liquid crystal display device, comprising:

driving a liquid crystal display panel;

controlling operation of a gate driver using synchronization signals provided from a system controller;

measuring a voltage level of a signal provided to a liquid crystal display panel of the liquid crystal display device;

selecting a reference signal having the lowest voltage level among voltage-related signals generated by the driver IC;

comparing the measured voltage level of the signal with a reference voltage level of a normal state of the liquid crystal display panel; and initializing the signal provided to the voltage source of the liquid crystal display panel if the measured voltage level differs by a predetermined value from the reference voltage level, wherein the initializing signal provided to the liquid crystal display panel comprises initializing power-on sequence of the voltage source supplying the voltage.

13. The method of claim 12, wherein the signal comprises at least one of a gate high voltage, a gate low voltage provided to gate lines, and a reference signal generated by a voltage source.

14. The method of claim 12, further comprising predicting an occurrence of at least one of a black and white effect of the liquid crystal display panel if the measured voltage level differs from the reference voltage level.

15. A method of driving a liquid crystal display device, the method comprising:

driving a liquid crystal display panel;

controlling operation of a gate driver using synchronization signals provided from a system controller;

measuring at least one signal generated by a driver driving an liquid crystal display panel of the liquid crystal display device;

selecting a reference signal having the lowest voltage level among the at least one voltage-related signal generated by the driver IC;

comparing a measured signal with a normal state signal;

activating the driver when a voltage difference between the measured signal and the normal state signal is greater than a predetermined value; and predicting an occurrence of at least one of a black and white effect when the voltage difference between the measured signal and the normal state signal is greater than a predetermined value, wherein the activating of the driver comprises at least one of initializing a power on sequence of a voltage source in the driver and resetting the power on sequence of the voltage source in the driver in accordance with a control signal.

* * * * *